US010539386B2

(12) United States Patent
Cortés Contreras

(10) Patent No.: US 10,539,386 B2
(45) Date of Patent: Jan. 21, 2020

(54) MUZZLE BRAKE FOR FIREARMS

(71) Applicant: Pedro Cortés Contreras, Valencia (ES)

(72) Inventor: Pedro Cortés Contreras, Valencia (ES)

( * ) Notice: Subject to any disclaimer, the term of this patent is extended or adjusted under 35 U.S.C. 154(b) by 0 days.

(21) Appl. No.: 16/469,879

(22) PCT Filed: Dec. 24, 2017

(86) PCT No.: PCT/ES2017/070847
§ 371 (c)(1),
(2) Date: Jun. 14, 2019

(87) PCT Pub. No.: WO2018/122430
PCT Pub. Date: Jul. 5, 2018

(65) Prior Publication Data

US 2019/0316865 A1 Oct. 17, 2019

(30) Foreign Application Priority Data

Dec. 29, 2016 (ES) ..... 201631544 U

(51) Int. Cl.
*F41A 21/36* (2006.01)

(52) U.S. Cl.
CPC ..... *F41A 21/36* (2013.01)

(58) Field of Classification Search
CPC ..... F41A 21/36; F41A 21/30; F41A 21/34; F41A 21/28; F41A 21/38; F41A 1/08; F41A 21/32; F41A 25/00; F41A 27/30; F41A 21/26; F41C 27/00
USPC ..... 89/14.3
See application file for complete search history.

(56) References Cited

U.S. PATENT DOCUMENTS 1,174,165 A * 3/1916 Kenney ..... F41A 21/36 89/14.3
1,901,138 A * 3/1933 Barnes ..... F41A 21/36 89/14.3
3,298,280 A * 1/1967 Rahm ..... F41A 21/36 89/14.3
3,528,336 A * 9/1970 Donner ..... F41A 21/32 89/14.3
4,930,397 A * 6/1990 Seidler ..... F41A 21/325 89/14.3
6,276,251 B1 * 8/2001 Downing ..... F41A 21/36 89/14.3
6,578,462 B1 * 6/2003 Franchino ..... F41A 21/36 89/14.2
6,948,415 B2 * 9/2005 Matthews ..... F41A 21/30 42/1.06

(Continued)

FOREIGN PATENT DOCUMENTS

GB 2190474 A 11/1987

*Primary Examiner* — Joshua E Freeman
*Assistant Examiner* — Bridget A Cochran
(74) *Attorney, Agent, or Firm* — Richard M. Goldberg

(57) ABSTRACT

A muzzle brake for weapons includes a body (1) that is joined to the firearm (6) and that incorporates two recesses (1*a*, 1*b*) on its surface, where a plurality of holes (1*c*) are located; and in which on each of the recesses (1*a*, 1*b*) a body (2) is located, which incorporates, in turn, a plurality of holes (2*a*) coinciding in number with the holes (1*c*) and located in the opposite direction in such a way that there is a reverse of gases coming from the firing of the projectile from the weapon (6).

4 Claims, 3 Drawing Sheets

(56) References Cited

U.S. PATENT DOCUMENTS

| | | | | |
|---|---|---|---|---|
| 7,707,763 | B2 * | 5/2010 | Brixius | F41A 13/06<br>42/76.01 |
| 8,087,338 | B1 * | 1/2012 | Hines | F41A 21/30<br>181/223 |
| 8,973,481 | B2 * | 3/2015 | Dueck | F41A 21/325<br>181/223 |
| 9,322,607 | B1 * | 4/2016 | Lau | F41A 21/30 |
| 10,036,605 | B1 * | 7/2018 | Kosman | F41A 21/38 |
| 2016/0123689 | A1 * | 5/2016 | Maeda | F41A 21/30<br>89/14.3 |
| 2017/0343311 | A1 * | 11/2017 | Deros | F41A 21/34 |

* cited by examiner

MUZZLE BRAKE FOR FIREARMS

SUMMARY OF THE INVENTION

The purpose of the present invention is a muzzle brake for firearms, especially in those of large caliber, which reverses the gases and the water hammer of the front module of said muzzle brake by using the inertia of the gases that have not been redirected by the primary module when it is fired to balance the recoil, thereof decreasing its impact towards the user of said weapon.

BACKGROUND FOR THE INVENTION

We can currently define the recoil of a firearm as when, due to the force caused by the exit of the projectile at the moment of firing, a force is generated that moves in the opposite direction, which causes the shooter to have to resume position and again place the target in the aiming elements, losing valuable seconds that can determine the outcome of the operation. This, when applied to artillery batteries, involves realigning all the systems and re-aiming the guns with a significant loss of seconds that while under enemy fire are very valuable tactically; the same problem happens with battle tanks: while they realign the gun turret, tank and crew are exposed to enemy fire; these seconds are very valuable.

This solution is not enough to alleviate all the recoil, so there are other solutions in the state of the art, such as the known muzzle brakes, which are devices that are coupled to the barrel, allowing the outflow of gases as quickly as possible so that they contribute as little as possible to the recoil.

The main drawback of current muzzle brakes is that they only direct the gases in the direction in which they are moving, while the muzzle brake of this invention forces the gases to take the direction opposite to that in which they would naturally move by exerting a series of forces that cause thrust in the opposite direction to the movement of the recoil of the weapon, and also, the hammer module violently strikes at the end of its stroke, pulling the assembly forward, cancelling out even more the frontal movement that mitigates the recoil.

DESCRIPTION OF THE INVENTION

The technical problem that the present invention resolves is to obtain a new muzzle brake for firearms that makes it possible to decrease the recoil of the firearm once the projectile is fired. For this, the muzzle brake for firearms, the object of the present utility model, is characterized because it comprises a body that is joined to the firearm and incorporates two recesses on its surface, where a plurality of inclined holes are located at approximately 45°. On each of said recesses is a body with holes. On the body, a series of internal springs are housed longitudinally through holes through which there also extend guide rods and tubular bodies that join said body with a series of baffles or hammer module responsible for redirecting the rest of the gases that have not been redirected through the holes, and for violently pulling the solid body that holds said baffles, in the same direction as the gas outflow.

In another practical embodiment, the muzzle brake recommended here will be embodied in a monoblock body, the recesses not being necessary.

Thanks to its design, the muzzle brake presented here will be able to redirect the detonation gases in the opposite direction to the projectile exit, thus causing the thrust forces that are produced in said detonation to balance the weapon's recoil forces. This happens thanks to a series of baffles designed to capture the gases that have not been redirected by the first body, and to violently pull the solid body carrying said baffles in the same direction as the gas outflow.

Thus, these baffles joined to the first body and supported by guide rods cause it, upon reaching the end of the stroke and impacting at the end of stroke, to transmit a water hammer effect on the muzzle of the weapon, which is intended to reduce the recoil forces that begin to act at that moment.

Throughout the description and the claims, the word "comprises" and its variants do not intend to exclude other technical characteristics, additives, components or steps. For experts in the field, other objects, advantages and characteristics of the invention will be derived in part from the description and in part from the use of the invention. The following examples and figures are provided by way of illustration and are not intended to restrict the present invention. The present invention also covers all possible combinations of particular and preferred embodiments indicated herein.

BRIEF DESCRIPTION OF THE DRAWINGS

A very brief description is given below of a series of illustrations that help to better understand the invention and which are expressly related to an embodiment of said invention that is presented as a non-limiting example.

DETAILED DESCRIPTION OF THE PREFERRED EMBODIMENT OF THE INVENTION

Figure 1:
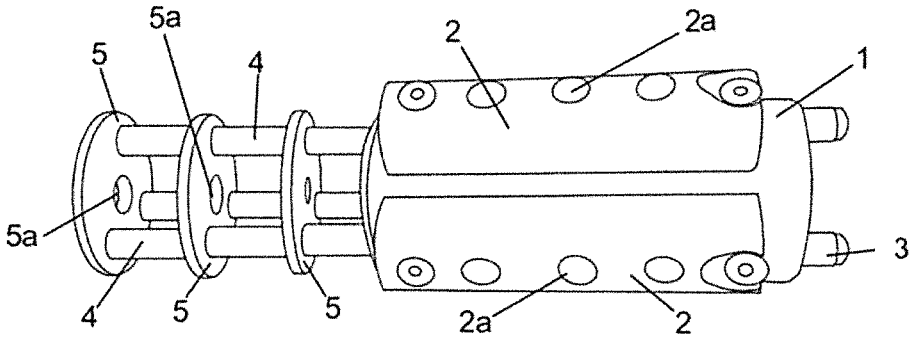
FIG. 1 shows a view of the muzzle brake for a firearm that is the object of the present utility model.
Figure 2:
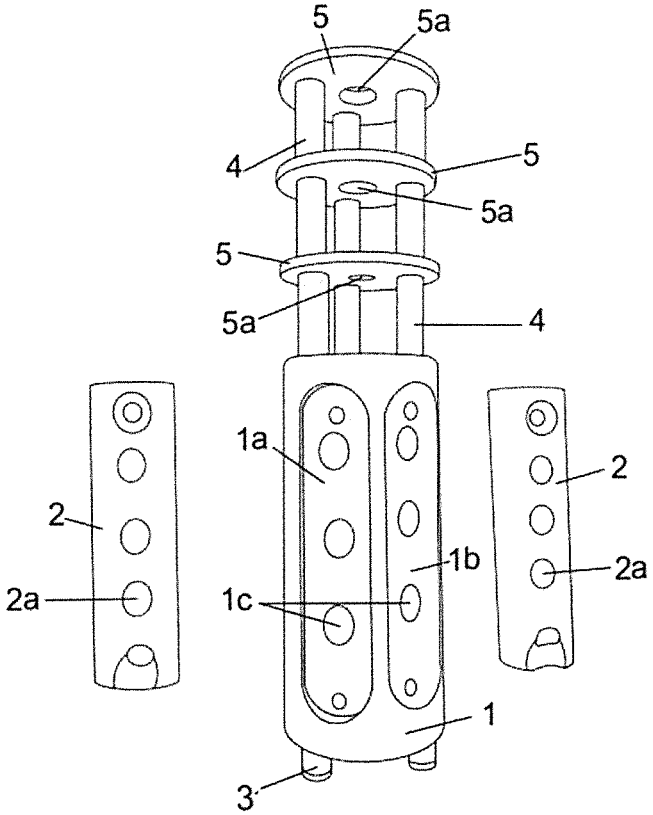
FIG. 2 shows a second view of the muzzle brake for a firearm, with the bodies (2) disassembled.
Figure 3:
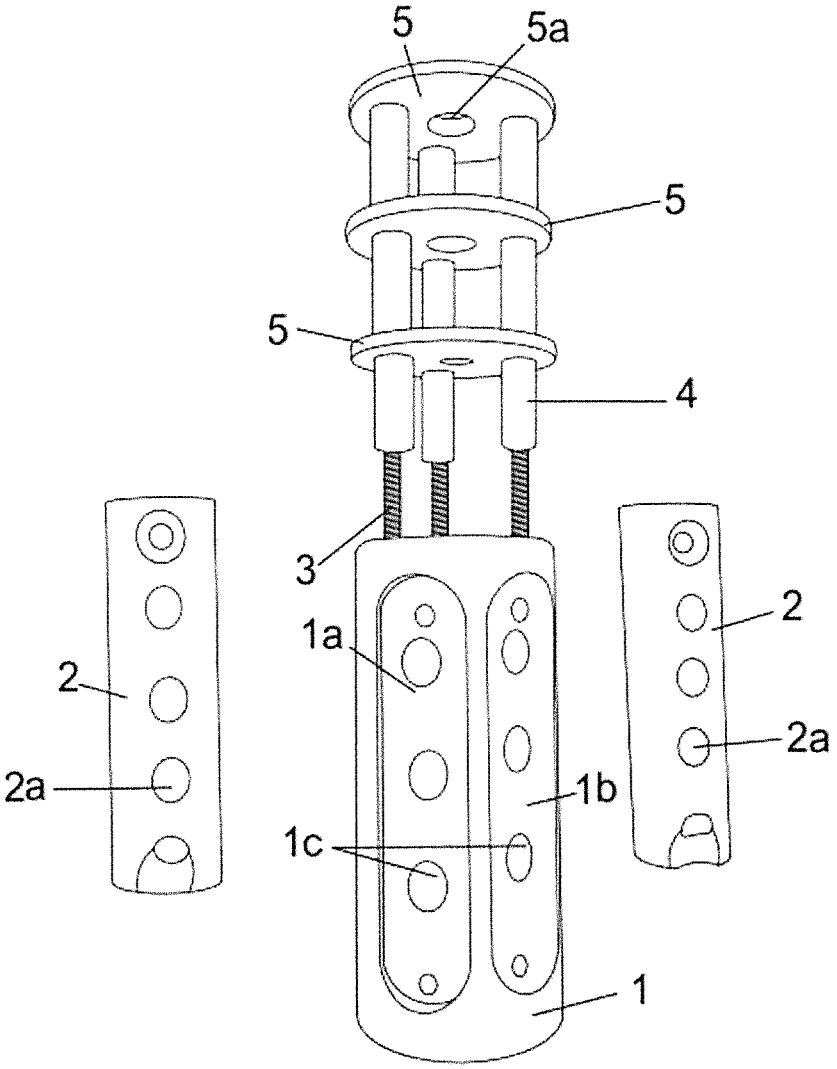
FIG. 3 shows a third view of the muzzle brake for a firearm, with the disassembled bodies (2), the hammer module (5) extended and the guide rods (3) in view.
Figure 4:
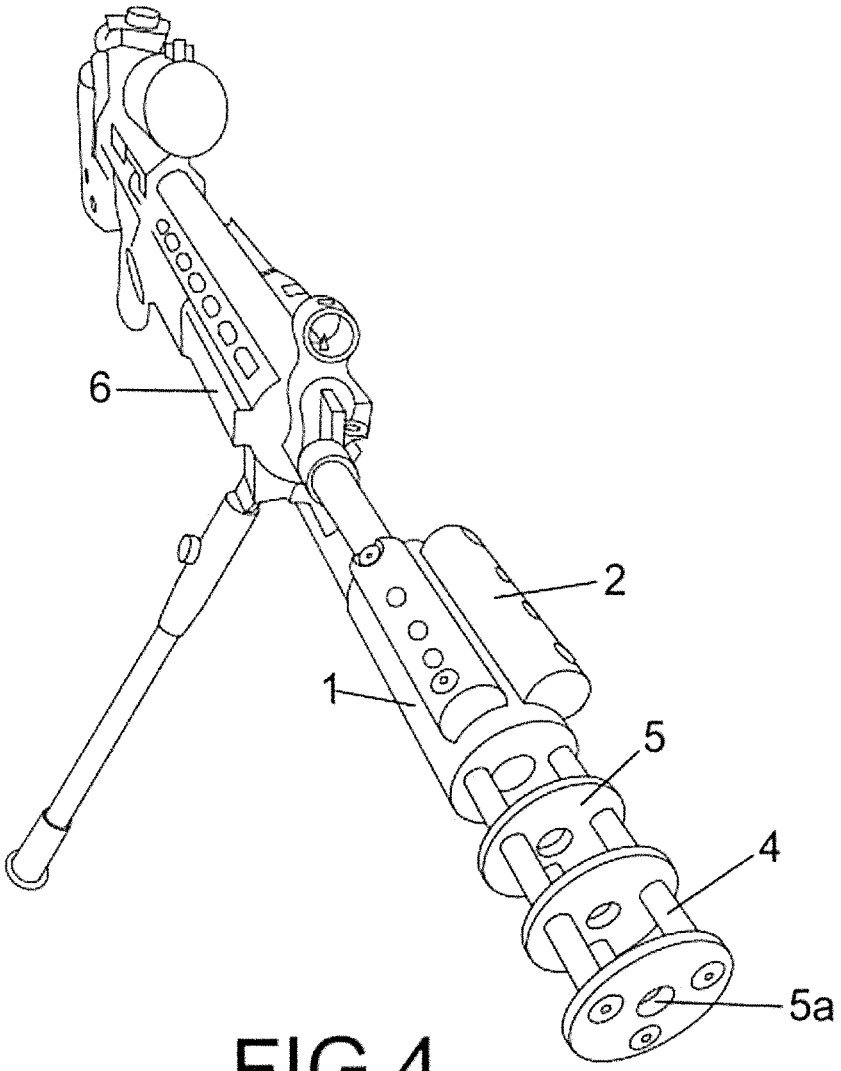
FIG. 4 shows a view of the muzzle brake placed on a weapon.

A preferred embodiment of the invention is shown in the attached figures. More specifically, the muzzle brake for weapons, the object of the present utility model, is characterized because it comprises a primary body or module (1) that is joined to the firearm (6), and where said body (1) has a central channel that ends in a central hole, which allows the exit of the projectile once it has been fired.

The body (1) incorporates two recesses (1*a*, 1*b*) on its surface, where a plurality of holes (1*c*) inclined at approximately 45° are located; and in which each of said recesses (1*a*, 1*b*) a second body (2) is respectively located, which incorporates a plurality of holes (2*a*) coinciding in number with the holes and arranged at the same angle in the opposite direction (1*c*) present on the recesses (1*a*, 1*b*) in such a way that there is a reverse of gases coming from the firing of the projectile from the weapon (6).

The holes (1*c*, 2*a*) will be aligned in opposite directions so as to force the gases to be compressed and redirected back to the area of the shooter and not in their natural orientation.

The body (1) incorporates a series of internal springs that are housed and cross it longitudinally through holes through which there also extend guide rods (3) and tubular bodies (4) that join said body (1) with a series of baffles or hammer module (5) responsible for redirecting the rest of the gases that have not been redirected through the holes (1*c*, 2*a*) and for violently pulling the solid body that holds said baffles, in the same direction as the gas outflow.

The baffles (5) will each have a central hole (5*a*) coinciding in location with the axis created between the weapon's barrel (6) and the central hole of the body (1), and that allows the projectile to exit.

In a particular embodiment, the muzzle brake recommended here will be embodied in a monoblock body, without ruling out other manufacturing solutions, such as their embodiment in several parts that can be assembled later.

What is claimed is:

1. A muzzle brake for weapons comprising:

a main body adapted to be joined to a firearm, said body including:

a central channel that ends in a central hole, which allows a projectile from the firearm to exit once the projectile has been fired, two recesses on an outer surface thereof, each recess including a plurality of first holes inclined at approximately 45° in a direction of firing of the projectile;

a second body on each of said recesses, each second body including a plurality of second holes coinciding in number with the first holes in the recesses and inclined in an opposite direction from said first holes in such a way that there is a reverse of gases coming from the firing of the projectile from the weapon;

a series of internal springs that are housed in the main body and cross the main body longitudinally through longitudinal holes in the main body;

guide rods that extend through the longitudinal holes;

a series of baffles; and tubular bodies that join said main body with said series of baffles which are responsible for redirecting a remainder of the gases that have not been redirected through the first and second holes and for violently pulling the main body that holds said baffles, in the same direction as gas outflow from the firing of the projectile.

2. The muzzle brake according to claim 1 in which the baffles each have a central hole coinciding in location with an axis created between a barrel of the firearm and the central hole of the main body, and that allows the projectile to exit.

3. The muzzle brake according to claim 1 in which the muzzle brake is embodied in several parts assembled to one another.

4. The muzzle brake according to claim 2 in which the muzzle brake is embodied in several parts assembled to one another.

* * * * *